US006481795B1

(12) United States Patent
Pettibon

(10) Patent No.: US 6,481,795 B1
(45) Date of Patent: Nov. 19, 2002

(54) THERAPEUTIC CHAIR

(76) Inventor: Burl Pettibon, 89 Raft Island Dr., Gig Harbor, WA (US) 98335

( * ) Notice: Subject to any disclaimer, the term of this patent is extended or adjusted under 35 U.S.C. 154(b) by 0 days.

(21) Appl. No.: 09/587,521

(22) Filed: Jun. 5, 2000

(51) Int. Cl.[7] ..... A47C 3/00

(52) U.S. Cl. ..... 297/314; 397/195.11; 397/215.15; 397/344.21; 397/411.36; 397/452.25; 397/452.26

(58) Field of Search ..... 297/195.1, 195.11, 297/215.13, 215.15, 325, 314, 314.14, 344.21, 411.36, 411.4, 452.21, 452.23, 452.24, 452.25, 452.26, 452.27, 452.28, 254.1, 313; 482/130, 142; D6/344, 354, 363

(56) References Cited

U.S. PATENT DOCUMENTS 4,099,697 A * 7/1978 Von Schuckmann .... 297/314 X
4,607,882 A * 8/1986 Opsvik ..... 297/195.11
5,113,851 A * 5/1992 Gamba ..... 297/330 X
5,590,930 A 1/1997 Glockl ..... 297/258.1
5,649,740 A * 7/1997 Hodgdon ..... 297/303.1
5,660,442 A * 8/1997 Tornero ..... 297/411.36
5,711,576 A * 1/1998 Olson et al. ..... 297/353
5,727,759 A * 3/1998 Christensen ..... 297/411.36 X
5,728,049 A * 3/1998 Alberts ..... 297/314 X
5,921,630 A * 7/1999 Cassaday ..... 297/353
6,033,021 A * 3/2000 Udo et al. ..... 297/313
6,123,390 A 9/2000 Greenwald ..... 297/344.12
6,139,098 A * 10/2000 Carrillo ..... 297/202
6,176,548 B1 * 1/2001 Thole et al. ..... 297/302.1
6,209,958 B1 * 4/2001 Thole ..... 297/302.1
6,357,827 B1 3/2002 Brightbill et al. ..... 297/233

* cited by examiner

*Primary Examiner*—Carl D. Friedman
*Assistant Examiner*—Brian E. Glessner
(74) *Attorney, Agent, or Firm*—Seed IP Law Group PLLC

(57) ABSTRACT

A therapeutic chair having a seat, a base configured to rest on a surface, and a seat support mechanism configured to couple the seat to the base and to enable the seat to be rocked in any direction while resisting rocking of the seat. Ideally the seat-support mechanism permits universal motion in all directions about a vertical axis, including 360 degrees of rotation, 40 degrees of side-to-side flexion, and 35 degrees of front-to-back flexion on a universal-type joint. The joint includes a first support member having a projecting post and a second support member having a housing with first and second resilient members mounted therein and configured to slidably receive the post. A unique seat design in combination with the universal seat connector reduces pressure on the legs and facilitates therapeutic exercise when seated.

20 Claims, 7 Drawing Sheets

THERAPEUTIC CHAIR

TECHNICAL FIELD

The present invention pertains to a therapeutic chair, and, more particularly, to a unique seat design and universal seat connector that reduces pressure on the back of the legs, especially the veins, and facilitates therapeutic exercise when seated.

BACKGROUND OF THE INVENTION

Mobile tissue, and, in particular, the spine, is susceptible to a variety of disorders resulting from active misuse and sedentary neglect. It has been shown that approximately 90% of chronic pain is located in the musculoskeletal system, with the prevalence of pain in individuals up to 59 years of age commonly occurring in the head, neck, shoulders, low back, legs, and pelvis. Some form of acute and chronic spinal pain will affect almost 80% of individuals in the western world. Musculoskeletal conditions have been recognized as a major cause of health and economic problems, with spine-related disorders second only to the common cold as a reason for absence from work.

Sleep disorders are also related to back pain, such as restless leg syndrome, periodic limb movement disorders, and sleep apnea. Backaches and leg pains are considered a major cause of sleep deprivation and have been attributed to a substantial loss of work productivity and work-related injuries.

While it has been assumed that lifting and bending accidents were the common cause of back injuries, approximately 80% of the U.S. population now have sedentary jobs requiring them to sit for up to eight hours per day. Factoring in the additional sitting time for work-related travel and resting or watching television, individuals may be sitting up to fifteen hours per day. While bending and lifting accidents can occur suddenly with known causes, a sedentary worker's back-related problems will occur gradually with no apparent identifiable cause.

After about age 12, the vascular supply system to spinal disks will begin to atrophy. The aging disks need just as much daily nutrition intake, metabolic waste, and algogenic inflammatory exudate elimination as they did before becoming avascular. It is generally accepted that a daily full range of motion, identified as "osmosis and imbibition" is absolutely essential for daily metabolic interchange. That is, nutrition intake and elimination of waste products must occur in order to maintain healthy, well-hydrated spinal disks, ligaments, and tendons.

In contrast, it has been found that up to 500 days is required for metabolic interchange by patients who are sedentary and patients who do not engage in a daily full-range spinal workout. The full-range workout is necessary to mix the glucosaminoglycans, chondroitin sulfate, and the proteoglycan aggregates that then nourish the disks and other avascular tissues.

Clinical observations have established the deleterious effects of the immobilization of joints and tissues in patients. It has also been observed that early active motion as opposed to prolonged immobilization of diseased and injured parts provides beneficial local effects. In addition, active and passive motion of the spine and extremities will reduce a patient's susceptibility to necrosis resulting from prolonged immobilization.

Thus, the best treatment and maintenance of healthy mobile tissue, such as the spine, is motion. It is well known that the biomechanics of the spine involve six degrees of motion (flexion, extension (right and left), rotation (right and left), lateral bending, and long-axis distraction and compression (load/unload cycling)).

During the normal gait or walking cycle, the spine is in a lordotic position, wherein portions of the spine receive a circumductive load-and-unload force. This cycle occurs each time a step is taken as gravity forces the body downward. The pumping action creates a load/unload cycle along with a slight rotational component as the arms swing and the legs alternately step. Patients confined to wheelchairs, those suffering from spinal injuries, or otherwise healthy individuals subjected to prolonged immobilization are unable to actively put the spinal column in motion and achieve the required circulation of blood and intercellular fluids through the spinal region, including the disks and legs.

One attempt to provide motion to seated workers is described in U.S. Pat. No. 5,113,851 issued to Gamba on May 19, 1992 for a chair equipped with a swinging seat. Gamba teaches the mounting of a seat to a base through an articulated ball joint mechanism with movement induced by a motor through a gear train assembly. Hence, Gamba provides passive motion, i.e., motion produced by an external force, using a complicated, expensive, and cumbersome motor and gear train assembly. Moreover, the articulated ball joint assembly provides no structure for resisting movement of the seat or maintaining the seat in a relatively horizontal position when no force is applied or when not in use. In addition, the seat of Gamba provides no relief for pressure on the legs of a user.

SUMMARY OF THE INVENTION

The present invention is directed to a therapeutic chair having a seat, a base for supporting the seat on a surface, and a seat support mechanism configured to couple the seat to the base and enable the seat to rock in any direction with respect to the base and to resist rocking of the seat. Ideally, the seat support mechanism returns the seat to a starting position, such as a horizontal position, when no force is applied or when not in use.

In accordance with another aspect of the present invention, the seat support mechanism includes a first support member configured for mounting to one of either the seat or the base and a second support member configured for attachment to the other of the seat and the base and further configured to receive the first support member in slidable engagement, the second support member including at least one resilient member configured to urge the first support member into alignment with a longitudinal axis of the second support member.

In accordance with a further aspect of the present invention, the first support member is a post having a longitudinal axis and the second support member is a housing with a longitudinal axial bore defining an interior, and further including at least one resilient member mounted in the housing interior with a central opening that is sized and shaped to receive the post.

In accordance with yet another embodiment of the present invention, a therapeutic chair is provided having a seat and a base for supporting the seat on a surface, the seat having a substantially triangular planform shape with an apex portion configured to be straddled by a user's legs and a base portion configured to support the user in a seated position. Ideally, the apex portion of the seat is upturned, as are first and second corners of the base portion.

In accordance with still yet another aspect of the present invention, the seat has a top surface and a bottom surface, and the top surface has a dished configuration such that the apex portion and first and second comers of the base portion are upturned.

In accordance with yet a further embodiment of the present invention, a therapeutic chair is provided having a hydraulic, adjustable-height seat with 360 degrees of rotation, 40 degrees of side-to-side flexion, and 35 degrees of front-to-back flexion on a universal-type joint to facilitate all possible combinations of exercise motion.

As can be readily appreciated from the foregoing description, the therapeutic chair of the present invention has a pyramid-shaped seat. The top of the pyramid faces forward. The seat rests on a universal joint that enables controlled motion by a user in all directions as the user moves, while simultaneously ensuring stability of the arms, back, and chair base. The unique seat is designed for freedom of leg motion and blood circulation. This design combined with user-controlled motion allows for continuous spinal, low back, and leg macro and micro-motions to prevent accumulative trauma injuries to the back, relief for aching legs, and prevention of varicose veins. The arms of the therapeutic chair are adjustable to three inches higher than ordinary chair arms, which the user's arms to rest when working. The higher arms minimize the user's arm weight, thus not only preventing but also relieving chronic aching in the neck, upper mid back and shoulders, as well as carpal tunnel aggravations of the wrist and hands.

The back of the chair is not as tall as other chairs, allowing for support of the user's rib cage and the upper part of the low back without interfering with breathing. The back and the seat of the chair are adjustable for tilting backward or forward in combinations for the comfort of the user. The seat bottom may be tilted forward while the chair back is tilted backwards, or vice versa. In addition, the chair sits on an adjustable-height gas cylinder.

BRIEF DESCRIPTION OF THE DRAWINGS

The foregoing and other features and advantages of the present invention will be more readily appreciated as the same become better understood from the following description when taken in conjunction with the accompanying drawings, wherein.

DETAILED DESCRIPTION OF THE INVENTION

Figure 1:
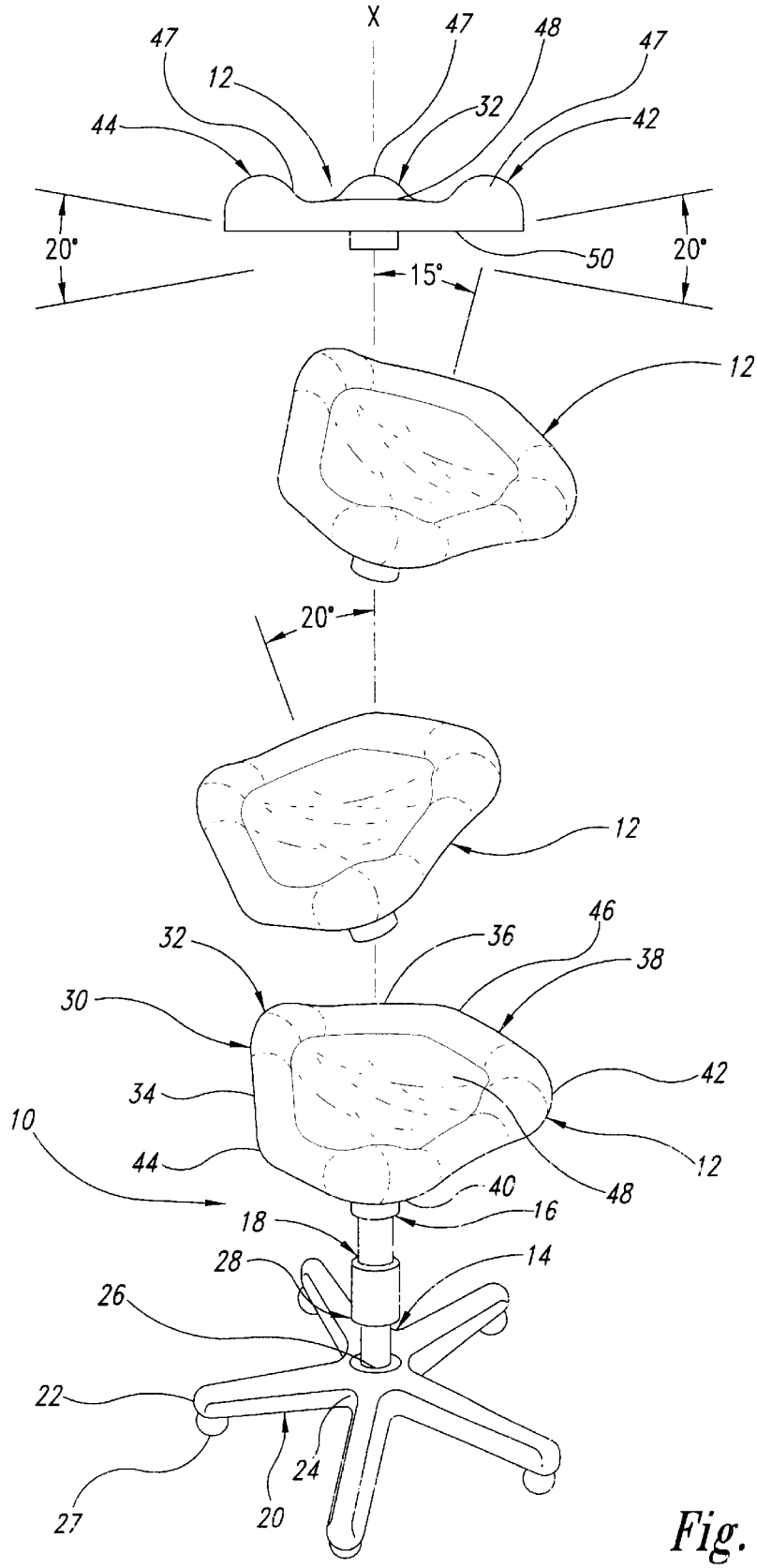
FIG. 1 is an isometric projection of a therapeutic chair formed in accordance with the present invention and showing the seat portion in alternative positions of articulation.

Referring initially to FIG. 1, shown therein is a therapeutic chair 10 formed in accordance with one embodiment of the present invention. The chair 10 includes a seat 12 mounted to a base 14 by way of a seat support mechanism 16 that includes a coupling 18. The base 14 has a plurality of legs 20, each leg 20 having a distal end 22 configured to bear against a support surface (not shown) and a proximal end 24 connected to a lower end 26 of a vertical support member 28. Wheels 27 or other surface contacts may be mounted on the distal end 22 of each leg 20 in a conventional manner known in the art.

The vertical support member 28 has an upper end to which is mounted the seat support mechanism 16 with coupling 18, which is further mounted to the seat 12. The coupling 18 is configured in a preferred embodiment to permit tilting of the seat 12 in any direction about a vertical axis X. As shown in FIG. 1, in this particular embodiment, the seat 12 has a range of motion that includes 360 degrees of rotation about the vertical axis X, 40 degrees of side-to-side flexion, and 35 degrees of front-to-back flexion to facilitate all possible combinations of exercise motion. The coupling 18 urges the seat 12 to an initial position wherein the seat 12 is in a substantially horizontal orientation.

The vertical support member 28 may include a hydraulic actuator that permits a user to raise or lower the seat 12 with respect to the base 14. Such hydraulic actuators are readily commercially available and may be used in a conventional manner with the chair 10. As such, the hydraulic actuator will not be described in detail herein.

The seat 12 in this embodiment has a pyramid or triangular planform shape. More particularly, the seat 12 has a forward portion 30 with an apex 32 formed by the intersection of first and second sides 34, 36 that are configured to allow a user's legs to straddle the apex 32 and a rearward portion 38 that is configured to support a user in a seated position. In the illustrated embodiment, the rearward portion 38 has a substantially rectangular planform shape with left and right rearward comers 40 and 42, respectively, and left and right intermediate corners 44 and 46, respectively, located between the rear corners 40, 42 and the sides 34, 36, respectively, of the apex 32. Ideally, the apex 32 and the left and right rearward corners 40, 42 are formed to project upward or include an upward projection 47. The seat 12 may be formed to have a concave top surface 48 with the apex and the left and right rearward corners 40, 42 curved upward. The bottom surface 50 of the seat 12 can assume a convex shape to match the concave shape of the top surface 48 or it may be formed to be substantially flat.

Figure 2:
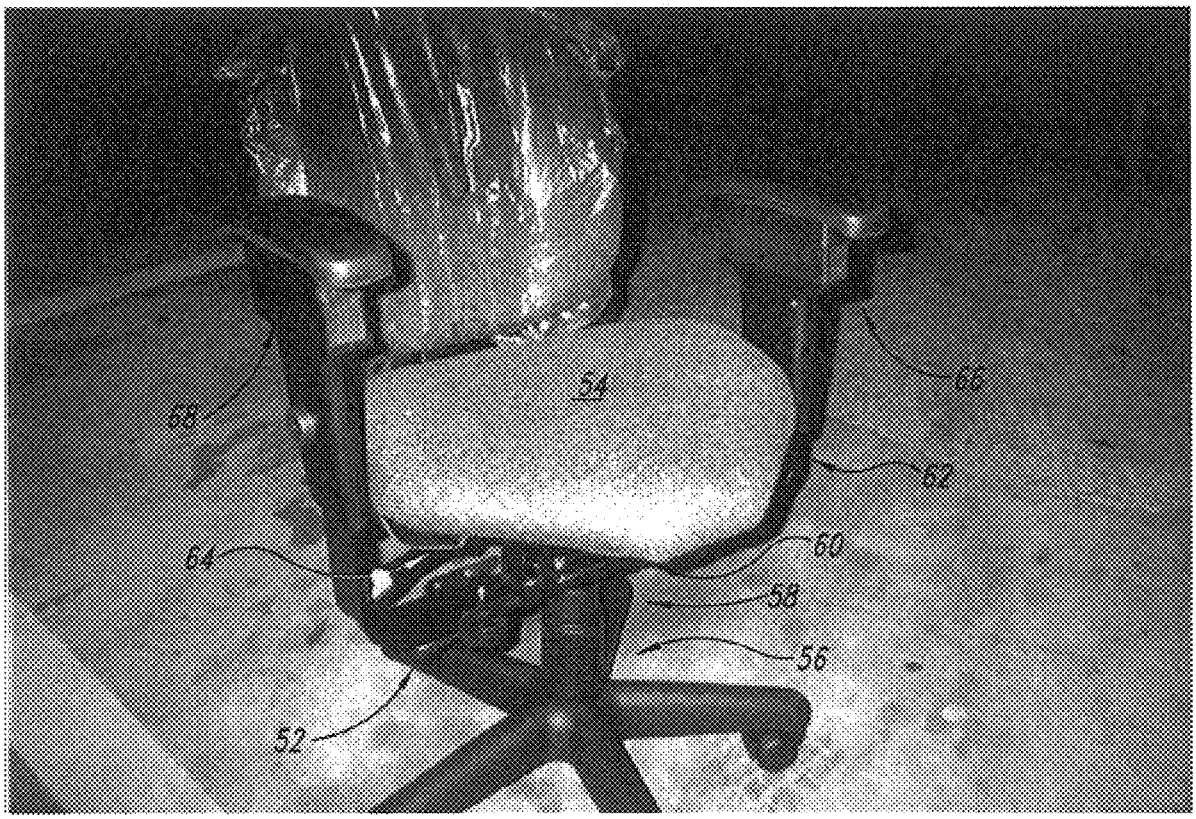
FIG. 2 is an isometric projection of a therapeutic chair formed in accordance with another embodiment of the present invention.
Figure 3:
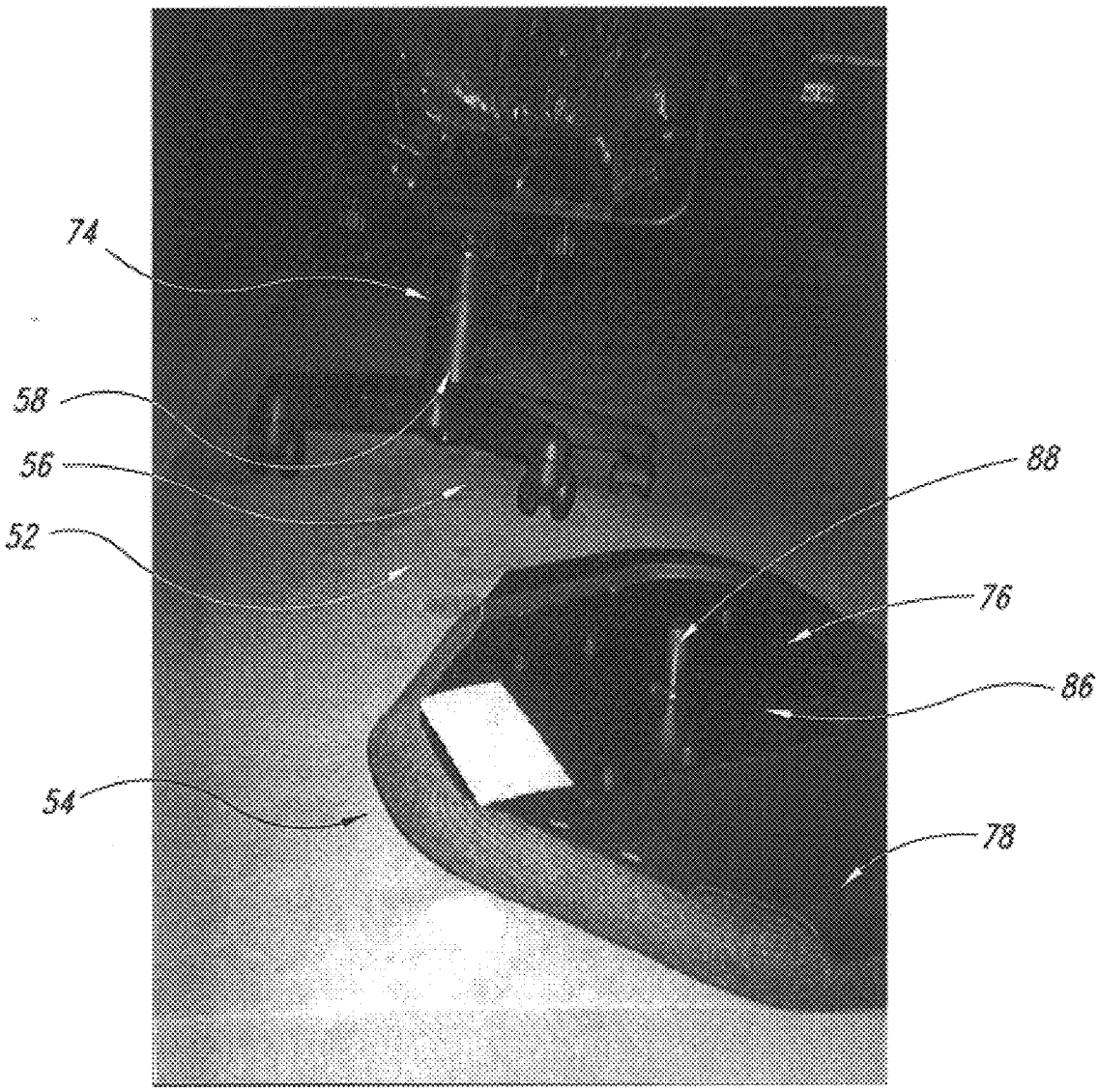
FIG. 3 is an isometric projection of the therapeutic chair of FIG. 2, with the seat portion removed.

Referring next to FIGS. 2 and 3, illustrated therein is another embodiment of a therapeutic chair 52 formed in accordance with the present invention. This chair 52 has a seat 54 mounted to a base 56 through a vertical support mechanism 58. A transverse member 60 is mounted to the vertical support mechanism 58 to extend outward horizontally. The transverse member 60 has upwardly-curved left and right vertical ends 62, 64, respectively. Slidably mounted to the left and right vertical ends 62, 64 are left and right arm rests 66, 68, respectively (shown more clearly in FIGS. 6 and 7). The height of the left and right arm rests 66, 68 may be individually adjusted using a conventional mechanism that is readily commercially available and which will not be described in detail herein.

Figure 6:
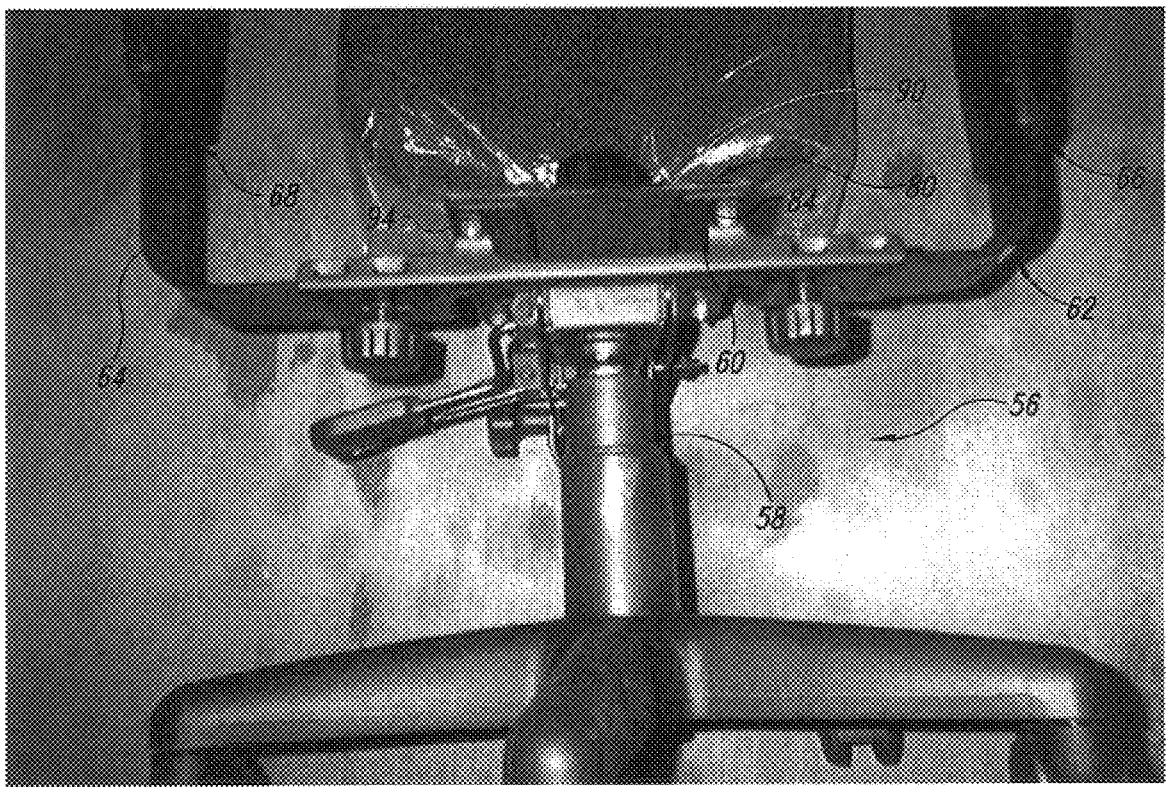
FIG. 6 is a front elevational view of the chair of the embodiment of FIG. 3 without the seat.
Figure 7:
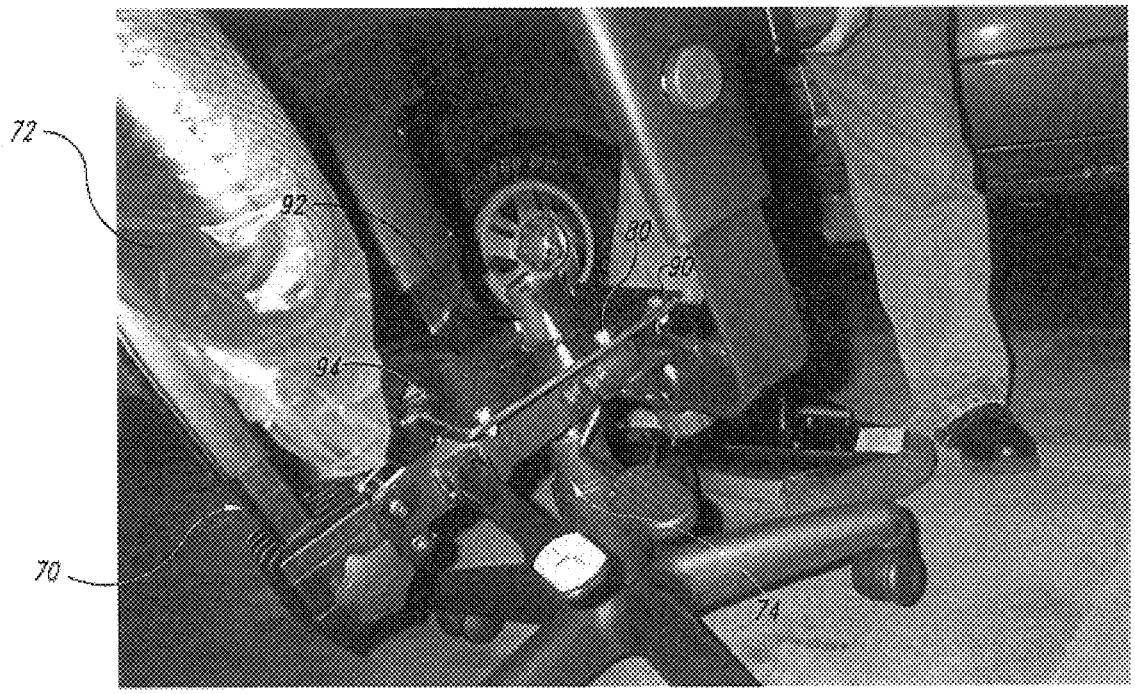
FIG. 7 is an isometric projection of the therapeutic chair of FIG. 6.

Referring to FIGS. 6 and 7, shown therein in greater detail is the transverse member 60 attached to the vertical support mechanism 58. Projecting at substantially a right angle from the transverse member 60 is a backrest support assembly 70 having a backrest 72 attached thereto. The backrest support assembly 70 is of a conventional construction that is readily commercially available and will not be described in detail herein. In one embodiment, the backrest 72 is shorter than conventional backrests. The shortened backrest facilitates support of the us&r's rib cage and the upper part of the low back without interfering with breathing.

As shown more clearly in FIGS. 3 and 7, the seat 54 has been removed to reveal a seat support mechanism 74. The seat support mechanism 74 includes a first support member 76 mounted to a bottom surface 78 of the seat 54, as shown in FIG. 3, and a second support member 80 attached to a top surface 82 of the backrest support assembly and to a flange 84 on the transverse member 60.

The first support member 76 is comprised of a plate 86 mounted to the bottom surface 78 of the seat. Projecting from the plate 86 is a post 88. In this embodiment, the post has a substantially circular cross-sectional configuration and is elongated along a longitudinal axis. The second support member 80 is comprised of a mounting plate 90 to which a coupling assembly 92 is attached, in this case by welding. However, the coupling assembly 92 may be integrally formed with the mounting plate 90. Conventional fasteners 94 attach the mounting plate 90 to the flange 84 on the transverse member 60 and to flanges extending from the backrest support assembly 70.

The mounting plate 90 is sized and shaped to avoid interference with a vertical height adjustment lever 98 and backrest position adjustment lever 100, shown more clearly in FIG. 7.

Figure 4:
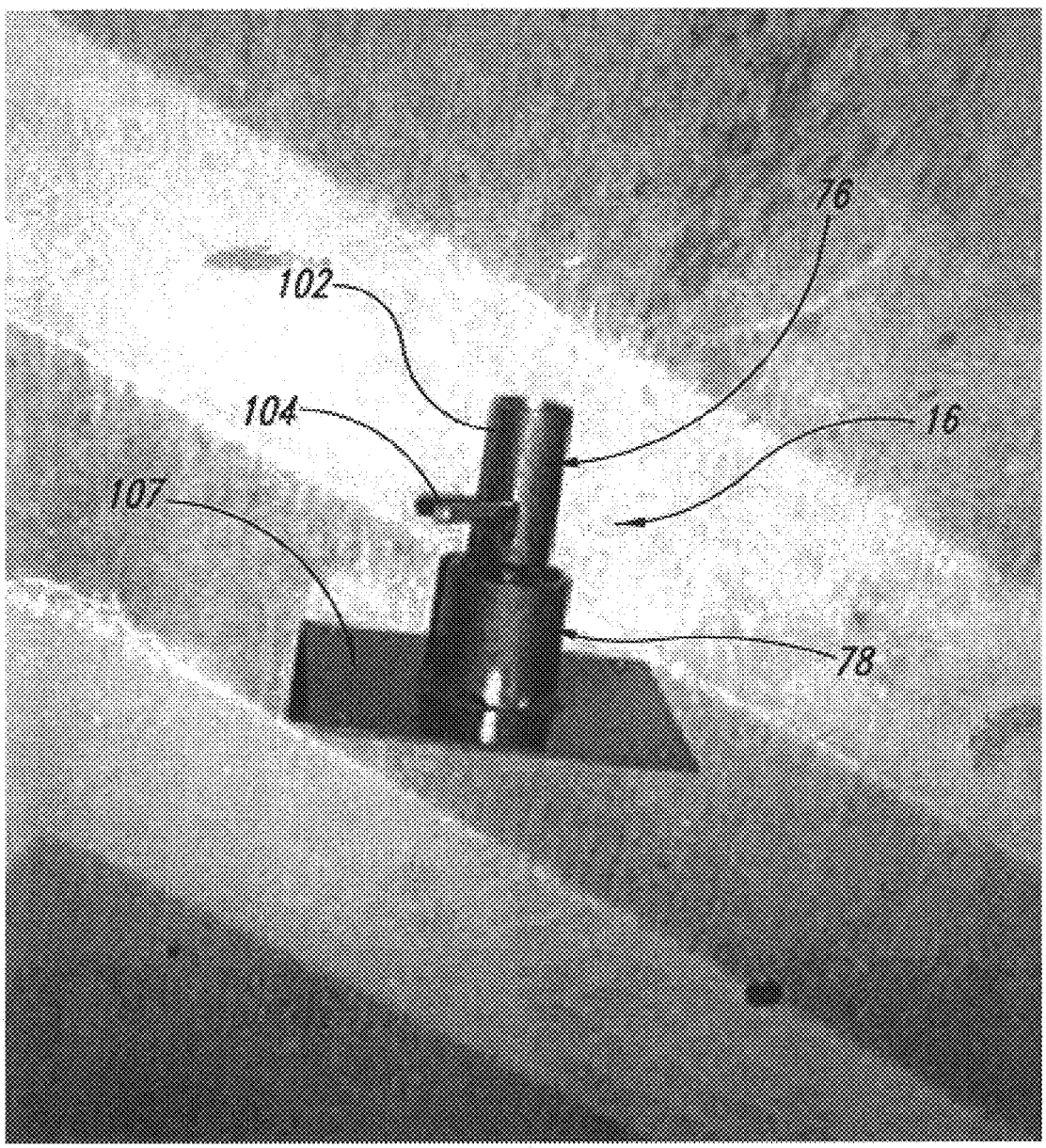
FIG. 4 is an isometric projection of a seat support mechanism formed in accordance with the present invention.
Figure 5:
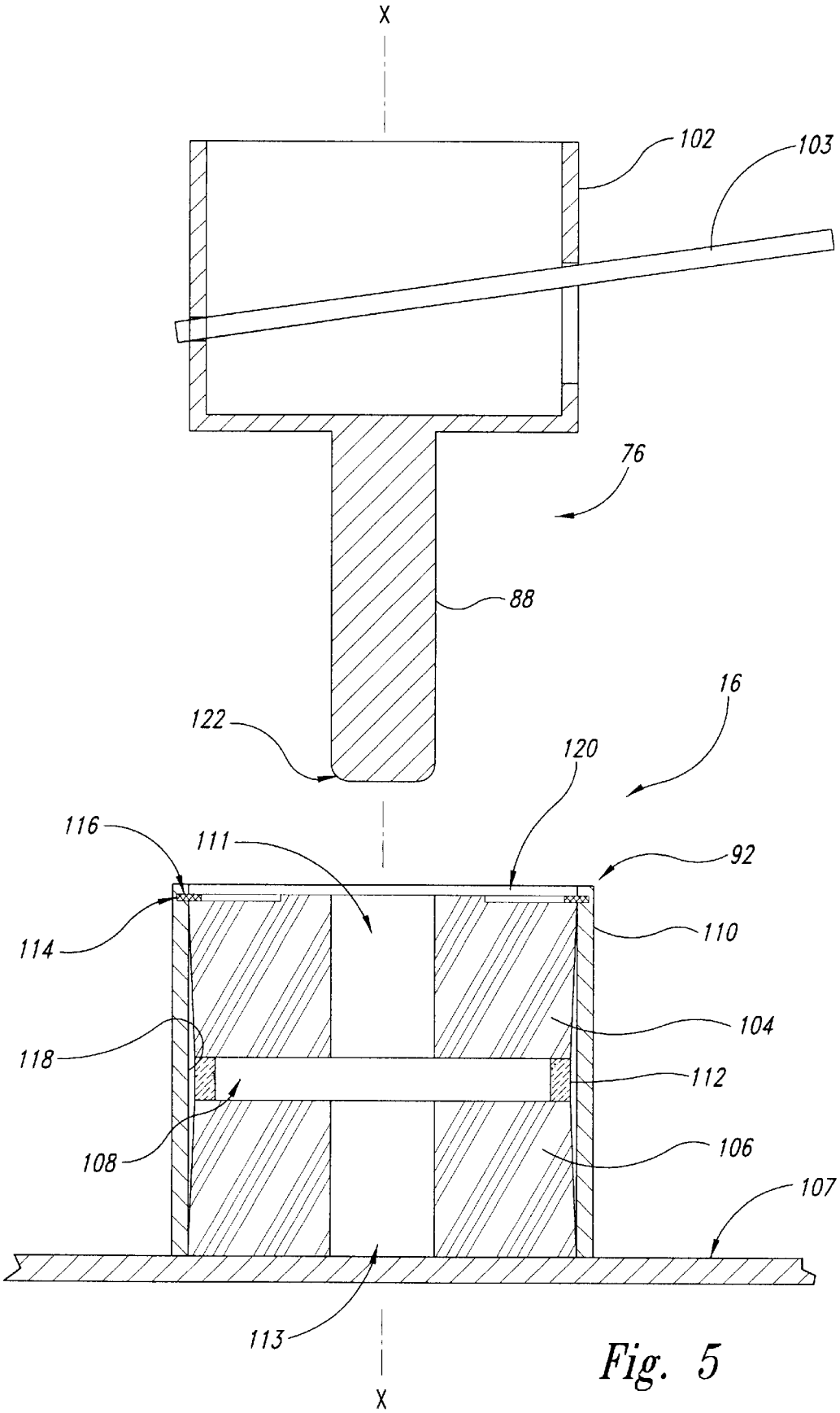
FIG. 5 is a cross-sectional partially-exploded view of the seat support mechanism of FIG. 4.

Referring next to FIGS. 4 and 5, shown therein in greater detail, is the seat support mechanism 16 used with the first embodiment of the therapeutic chair 10 as shown in FIG. 1. The first support member 76 is shown having the post 88 extending from a cylindrical tube 102. The tube 102 is sized and shaped to be coupled to a hydraulic actuator for adjusting the height of the seat 12 through a lever 103. This differs from the embodiment shown in FIG. 3, wherein the post 88 projects from the mounting plate 90.

The coupling assembly 92, as shown in cross section in FIG. 5, includes first and second resilient donut-shaped disks 104, 106, sized and shaped to be slidably mounted in a longitudinal axial bore 108 of a cylindrical housing 110. Each of the first and second resilient disks 104, 106 have a longitudinal axial bore 111, 113, respectively, sized and shaped to allow the post 88 to be slidably inserted into the housing 110 and through the disks 104, 106, preferably with a tight fit. A cylindrical spacer 112 holds the first and second disks 104, 106 apart when mounted inside the housing 110. The first resilient disk 104 is retained in the housing 110 by a C-clip 114 that is retained within an annular groove 116 formed on an interior surface 118 of the housing 110 adjacent an open end 120 of the longitudinal axial bore 108. The second resilient disk 106 bears against the plate 107, which in the embodiment of FIG. 1 is attached under the seat 12.

Each of the first and second resilient disks 104, 106 are formed of a hard yet compliant material, such as a hard rubber or, more preferably, material formed of neoprene, having a hardness in the range of 200 to 400 pounds maximum load. Such disks are readily commercially available and will not be described in greater detail herein.

The post 88 has a free end 122 that is slightly rounded such that when the post 88 is inserted into the coupling assembly 92, the free end 122 will bear against the mounting plate 90. The post 88 has sufficient length that the tube 102 (or plate 86 with the embodiment of FIG. 1) will not bear against or touch the housing 110. In the assembled configuration, as shown in FIG. 4, the first and second resilient disks 104, 106 hold the post 88 in an initial orientation such that a longitudinal axis X of the post 88 is aligned with a longitudinal axis X of the housing 110. Because the disks 104, 106 are formed of resilient material, a force exerted laterally on the post 88 will cause lateral compression of the disks 104, 106, allowing the post 88 to tilt at an angle with respect to the longitudinal axis of the housing 110. Lateral travel of the post 88 is limited by the disks 104, 106 and, ultimately, by the size of the housing 110.

In use, with either embodiment of the chair a user would straddle the apex of the seat with their legs while resting on the remaining portion of the seat. Hence, the user's legs are relieved of upward and inward pressure that impedes circulation while seated. The seat can then be tilted by the user as shown in FIG. 1.

The seat support mechanism or universal joint formed in accordance with the present invention enables controlled motion in all directions as the user moves. In the embodiment with the arms and backrest, stability of the arms and back are ensured during user-controlled motion. Ideally, a user performs a regimen of exercises using the therapeutic chair. Such exercises can include four sessions of full-range motion workouts necessary for the lower spinal disks during an eight-hour day. Full-range workout sessions consist of a total of 25 repetitions of side-to-side flexion and front-to-back flexion that carry the chair seat and low back through its full range of motion. Use of the chair with the stable back and higher arms during the workout will provide a user with a greater sense of security if needed. Full breathing during the exercises will improve vital capacity and the user's sense of well-being. Ideally, each set of twenty-five repetitions should take two minutes.

While a preferred embodiment of the invention has been illustrated and described, it is to be understood that various changes may be made therein without departing from the spirit of and scope of the invention. For example, the resilient disks 104, 106 may be replaced by a single resilient disk that extends the length of the housing 110. However, two resilient disks 104, 106 are used in the preferred embodiment because two disks allow the desired lateral flexion and rotation producing one combined motion that closely mimics normal spinal motion. Hence, the invention is to be limited only by the scope of the claims that follow and the equivalents thereof.

What is claimed is:

1. A therapeutic chair, comprising:

a seat;

a base configured to rest on a surface: and a seat-support mechanism configured to couple the seat to the base and enable the seat to be rotated 360° about a vertical axis, and to be rocked 35° in a front-to-back direction and 40 degrees in a side-to-side direction with respect to the vertical axis the seat-support mechanism comprising a first support member extending from one of either the seat or the base and a second support member attached to the other of the seat and the base and configured to receive the first support member in slidable engagement, the second support member including first and second donut-shaped resilient members mounted in spaced parallel relationship and configured to receive the first support member in slidable engagement along a longitudinal axis of the first support member and to urge the first support member into alignment with a longitudinal axis the second support member.

2. The chair of claim 1, wherein the first support member comprises a post having a longitudinal axis, and the second support member comprises a housing having a longitudinal axial bore defining an interior, and the first and second resilient members are mounted in the longitudinal axial bore on opposing sides of a spacer, each of the first and second resilient members having an opening sized and shaped to receive the post of the first support member.

3. The chair of claim 2, wherein the seat has a triangular planform shape with a forward apex portion configured to be straddled by the user's legs and a rearward portion configured to support the user in a seated position.

4. The chair of claim 2, wherein the seat has a top surface and a bottom surface, and the apex portion projects outward from the top surface.

5. The chair of claim 4, wherein the rearward portion has first and second corners that project from the top surface of the seat.

6. The chair of claim 4, wherein the seat has a top surface and a bottom surface, and the top surface has a concave configuration.

7. The chair of claim 6, wherein the apex portion is upturned user and the rearward portion has at least first and second corners that are upturned.

8. The chair of claim 3, further comprising arms configured to be adjustably mounted to the base independent of the seat such that the height of the arms may be adjusted independent of the seat.

9. The chair of claim 8, further comprising a backrest mounted to the base.

10. The chair of claim 9, wherein the seat is adjustably mounted to the base through an actuator mechanism that enables the user to adjust the height of the seat while the user is supported on the seat.

11. A therapeutic chair, comprising:

a base;

a seat mounted on the base and having a triangular planform shape with an apex in a front portion and a rearward portion having a rectangular planform shape and first and second rearward corners that are formed to project upward; and a seat support mechanism coupling the seat to the base and configured to enable the seat to be rotated 360° about a vertical axis, and to rock 35° in a front-to-back direction and 40° in a side-to-side direction with respect to the vertical axis.

12. The chair of claim 11, wherein the seat has a top surface, and the apex has a surface projection that projects from the top surface of the seat.

13. The chair of claim 12, wherein the first and second corners of the rearward portion each have a surface projection that project from the top surface of the seat.

14. The chair of claim 11, wherein the seat has a top surface that is dished such that the apex and the first and second corners project from the top surface of the seat.

15. The chair of claim 11, further comprising a seat support mechanism for supporting the seat on the base, the seat support mechanism comprising a first support member extending from either the seat or the base, and a second support member attached to the other of the seat and the base and configured to receive the first support member in slidable engagement, the second support member comprising a housing that holds at least one resilient member configured to receive the first support member in slidable engagement along a longitudinal axis and to urge the first support member into alignment with a longitudinal axis of the second support member while permitting the first support member to tilt out of alignment in any lateral direction with respect to the longitudinal axis of the housing.

16. The chair of claim 15, wherein the first support member comprises a post having a longitudinal axis, and the second support member comprises a housing having a longitudinal axial bore defining an interior, and first and second resilient members mounted in the longitudinal axial bore, each of the first and second members having an opening sized and shaped to receive the post.

17. The chair of claim 16, further comprising a back mounted to the base independent of the seat, and further wherein the seat is mounted to the base such that a user can adjust the position of the seat with respect to the base along the longitudinal axis of the second support member.

18. A therapeutic chair, comprising:

a base;

a seat having a rearward portion with a substantially rectangular planform shape and a forward portion having a triangular planform shape that includes an apex formed by the intersection of first and second sides of the forward portion, the first and second sides are configured to enable the user's legs to straddle the apex to relieve upward and inward pressure on the user's legs, the rearward portion having first and second rearward corners that are formed to project upward; and a coupling mechanism attached to the seat and the base and configured to permit user-controlled rocking of the seat at least 30° in all directions with respect to a vertical axis.

19. The chair of claim 18 wherein the apex on the forward portion of the seat is formed to project upward.

20. The chair of claim 18 wherein the coupling mechanism is configured to permit user-controlled rocking of the seat 35° in a front-to-back direction and 40° in a side-to-side direction with respect to the vertical axis.

* * * * *

UNITED STATES PATENT AND TRADEMARK OFFICE

CERTIFICATE OF CORRECTION

PATENT NO. : 6,481,795 B1
DATED : November 19, 2002
INVENTOR(S) : Burl Pettibon

It is certified that error appears in the above-identified patent and that said Letters Patent is hereby corrected as shown below:

Column 6,
Line 66, "longitudinal axis the second support member." should read -- longitudinal axis of the second support member. --.

Column 7,
Line 13, "The chair of claim 2, wherein" should read -- The chair of claim 3, wherein --.

Signed and Sealed this

Thirteenth Day of May, 2003

JAMES E. ROGAN
*Director of the United States Patent and Trademark Office*